United States Patent [19]

Paulyson et al.

[11] 3,980,196

[45] Sept. 14, 1976

[54] LINING OF CONTAINERS FOR BULK CARGO

[75] Inventors: John T. Paulyson, London, England; John P. Travis, Hunlocks Creek, Pa.

[73] Assignee: United States Lines, Inc., New York, N.Y.

[22] Filed: May 21, 1975

[21] Appl. No.: 579,429

[52] U.S. Cl. ..... 220/1.5; 220/65; 248/99; 296/39 R

[51] Int. Cl.[2] ..... B65D 87/28; B65D 87/34

[58] Field of Search ..... 220/1.5, 63 R, 65; 105/423; 296/39 R; 222/10 S, 101, 183, 530; 248/95, 98, 99

[56] References Cited

UNITED STATES PATENTS

| | | | |
|---|---|---|---|
| 172,228 | 1/1876 | White | 105/423 X |
| 1,262,025 | 4/1918 | Dickson | 296/39 R X |
| 1,898,195 | 2/1933 | Lorenz | 105/423 |
| 2,300,449 | 11/1942 | Rowe | 105/423 |
| 2,712,797 | 7/1955 | Woehrle et al. | 296/39 R |
| 3,198,390 | 8/1965 | Beckman et al. | 222/10 S |
| 3,386,605 | 6/1968 | Lafont | 220/1.5 |
| 3,756,469 | 9/1973 | Clark et al. | 105/423 X |
| 3,868,042 | 2/1975 | Bodenheimer | 220/1.5 X |
| 3,904,084 | 9/1975 | Ukmar et al. | 220/63 R X |

FOREIGN PATENTS OR APPLICATIONS

| | | | |
|---|---|---|---|
| 579,845 | 7/1959 | Canada | 105/423 |

*Primary Examiner*—William Price
*Assistant Examiner*—Stephen Marcus
*Attorney, Agent, or Firm*—Brooks Haidt Haffner & Delahunty

[57] ABSTRACT

A pair of flexible, load distributing, front cross members, a rear frame, and a rear bulkhead mounted on the rear frame, mount and securely retain a flexible bag as a liner within a freight container, truck trailer or the like, to adapt the container for bulk cargo transport. The front cross members retain the front end of the liner bag in generally rectangular configuration and are secured at opposite ends to structural members of the container, thus supporting the front end of the bag against displacement and possible damage or rupture, and transmitting the bag forces to the structural members. The rear frame and a curved bulkhead mounted thereon support the rear end of the bag and similarly prevent its rupture or collapse during loading and tilt-unloading. The laterally curved rear bulkhead also acts as a funnel to completely evacuate the bag contents during tilt-unloading through an opening therethrough. The arrangement is inexpensive and easy to install and, although all of its components may be disposed of after a single use, at least the cross members and the frame components can be reused.

20 Claims, 12 Drawing Figures

LINING OF CONTAINERS FOR BULK CARGO

The present invention relates to the handling of bulk cargo and more particularly to means by which a large plastic liner bag can be mounted in a conventional freight container, particularly the familiar road-hauled trailer vans, for the transportation of bulk cargo. These containers are now a conventional adjunct in modern marine transportation networks.

Standardized containers or boxes have come into very extensive use for the "containerized" shipment of freight by land and sea, and the manifest advantages of such containers have made it extremely desirable to adapt them for use with as many types of cargos as possible. Accordingly, there have been attempts, with varying degrees of success, to adapt conventional containers for use as carriers of dry bulk cargo. It is important to keep these containers clean for reuse, with different bulk cargo shortly after unloading, and such bulk cargos themselves must remain free of contamination by remnants of the last-carried cargo, or by exposure. When handling bulk cargo in the form of powder or fine granules, cargo leakage and spilling problems arise.

As early as 1918, a U.S. Pat. No. 1,262,025 was granted for a removable liner arrangement in a railroad box-car, but modern freight containers, along with modern loading and unloading techniques, have revolutionized freight transportation. However, the idea of installing a temporary bag liner to adapt such conventional containers to carry bulk cargo has the advantage that, after the cargo is delivered, the liner bag can be removed so that the container is again usable, without significant cleaning, to carry other cargo. There has been an acceleration of the search for reliable and inexpensive ways to handle bulk cargo as efficiently as other kinds of freight, by fitting standard containers with flexible liner bags.

Modern freight containers are widely used for transport by ship and rail, as well as by road when mounted on wheeled chassis, and are provided in standard trailer truck sizes of about 8 or 8.5 feet high, 8 feet wide and either 20 or 40 feet in length. Typically, a shipper loads the container which is mounted on a chassis, at the shipper's plant and the loaded container is then hauled by truck to dockside, lifted off the chassis and loaded on board a ship. After transport by ship the container is off-loaded onto another chassis and again hauled by truck and emptied on its cargo at its destination. The advantages of using containers that remain sealed from the shipper to the ultimate consignee are obvious.

Containers provided by such companies as Freuhauf Trailer Division of Fruehauf Corporation of Detroit, Michigan, and Trailmobile, Inc. of Cincinnati, Ohio, are currently used for shipping all types of freight, including bulk cargo. Though originally only break-built cargo was containerized, it has been found that bulk cargo can be economically containerized by lining the container with a disposable liner bag. Yet the difficulties in handling such commodities as dry bulk chemicals, acids and starches, powdered and pelletized resins, cement, clay, flour, coffee and grain in such bag liners have not been completely overcome, due to bag rupture under certain conditions of use.

For example, upon opening the rear doors at the time of unloading, there may be substantial rearward force on the bag, and on any conventional temporary bulkhead as may have been installed adjacent to the rear doors, either due to the forces exerted by the cargo in its natural angle of repose, or because the cargo has shifted back during transport. Similarly, upon tilting of the container by elevating its front end for unloading, in accordance with a conventional procedure for pouring cargo out through an opening formed at the lower rear of the bag, disposable liner bag arrangements of the prior art have been subject to tearing and collapse especially upon cargo-surging, as commonly occurs. Attempts have been made to solve these problems by using variously braced temporary cardborad and/or wooden bulkheads, or by hanging the bag from the container roof by means of many peripherally located hooks. Merely hanging the bag results in forces being concentrated at the attachment points during unloading, with the danger that the bag will tear by cascading, zipper-like failure at the several hanger locations.

In addition, there has been difficulty in completely emptying the bag contents when using prior liner and bulkhead arrangements, in that cargo residue tends to collect in the corner areas at the rear of the container as it is tilt-unloaded. Attempts have been made to alleviate this problem by providing a pair of discharge openings, one at each side of the liner bag adjacent the bottom. However, additional unloading chutes and arrangements are then required.

As described in the co-pending application Ser. No. 416,580, filed Nov. 16, 1973, entitled LINING OF CONTAINERS FOR BULK CARGO, and assigned to the assignee of the present application, various United States patents, such as U.S Pat. Nos. 3,386,605 and 3,696,952, deal with the problems encountered with lined cargo containers, such as spillage, liner support and unloading problems. An article in the Aug. 29, 1960 issue of the publication *Railway Age* also describes bulkheads for restraining load movement in such lined cargo containers.

It has been noted that high tearing stresses are induced on front ends of the bags during pressure loading by known procedures, and that tilt-unloading also causes high tearing stresses on the front ends of liner bags of the kind generally described in U.S. Pat. Nos. 3,386,605 and 3,696,952. The arrangements of those patents and of other prior container liner systems have not always been satisfactory in accommodating front end stresses when handling all types of bulk cargo, and the bulkhead arrangements proposed and used for rear ends of containers have usually required external support during tilting unloading, as shown, for example, in U.S. Pat. No. 3,696,952. It is desirable to eliminate the necessity for such external support.

The bulk cargo container liner suspension and bulkhead system described in said application Ser. No. 416,580 overcomes the difficulties experienced in prior art attempts to convert standard freight containers to bulk cargo use, by using existing structural components of the container itself to secure the liner bag positively during all modes of container operation. A frame arrangement at the forward end of the container supports a flexible liner bag in a desirable generally rectangular conformation during shipment and, as long as the frame is not deformed by loading forces, substantially evenly distributes stresses during transport and unloading so that, even during lift-unloading, there is little danger of tearing or collapse of the forward end of the liner bag. A rear end frame assembly supports a rigid though somewhat flexible arcuately-shaped, vertical bulkhead to provide support to the rear of the liner bag and its contents by transmitting loads to the container structure during transport and during unloading whether by tilting, vacuum or other known processes.

The primary forces acting on the bag during discharge appear to occur at the bottom front end of the bag, and hence, it is necessary to positively restrain the bag at this location. In the preferred embodiment described in said application Ser. No. 416,580, a front end frame is formed of interfitted tubular sections, which can be ordinary thin-wall pipe sections. A bottom cross member, which during use lies in the angle formed by the juncture between the floor and front wall of the container, has upturned tubular ends which receive side members that extend upwards and rearwards of a roof frame element of the container such as a roof-bow. At its lower front end, the liner bag is resiliently mounted on this bottom cross member, and at its upper front end, the bag is similarly mounted on a top cross member which is attached between respective support members which extend forwardly from the parallel side members. The various tubular members are of such size that, when the frame is in place, the top cross member which supports the top of the liner bag lies against the front wall of the container at a position spaced below the roof. It is also braced upwardly against the undersides of the respective upper corner castings of the container. The bag is secured along the full length of the bottom cross member so that forces are evenly distributed thereto, reducing stress concentrations and minimizing the chance of tearing. Because of the bracing action of the side members, forces tending to pull the bottom of the bag rearward, as developed during discharge, are transmitted to the roof-bow and floor of the container. Forces tending to pull on the upper front end edge of the bag are transmitted by the top cross member to the front wall of the container, as well as rearwardly to the frame side members and thence to the roof-bow.

At the rear end of the container in the preferred embodiment described in said application Ser. No. 416,580, the top edge of the bag is similarly attached to a cross member at the top of the rear frame, and a laterally curved, vertical, aluminum bulkhead provides support for the bag and its contents. The rear frame has inverted U-shaped appearance, and is formed by two upright but rearwardly canted parallel legs jointed at their upper ends by the cross member. The lower ends of the legs are respectively secured to a transverse bracing or spreader element extending across the width of the container. The legs and cross member of the rear frame can be pipe segments, and the bracing element is made of wood and has recesses and means for receiving and holding the legs in place.

During tilt-unloading of a container equipped with a rear frame and bulkhead arrangement according to said application Ser. No. 416,580, the curved bulkhead provides a "funnel" surface for more complete evacuation of the liner bag contents. Such bulkhead arrangement of the invention does not require the kind of external support needed by prior liner arrangements during unloading, is light in weight, and is adapted for use with containers having different scantlings with respect to the locations of their roof-bows, and for use with various types of unloading mechanisms and exisiting facilities. As an example, the rear bulkhead can be opened centrally at its lower portion to pour out contents through a hole made at the bulkhead opening of the liner bag. Since the bulkhead need not, and preferably does not, extend the full height of the container, loading is accomplished in conventional manner after the bulkhead is in its position by filling the bag through a loading aperture above the bulkhead.

It will be observed from an examination of the front frame structure shown in said application Ser. No. 416,580, and the manner in which it is supported and the liner bag is attached thereto, that rearward movement of the upper cross supporting member is resisted mainly by forces applied at laterally opposite ends thereof, and therefore, such supporting member is subjected to bending forces which must be resisted by a supporting member of adequate strength and rigidity. Similarly, the lower cross member is subjected to bending forces under load because the greater movement-opposing forces are applied at its ends. Because there is little resistance to movement of the ends of a cross member toward each other, the cross members, and the associated frame, can collapse after the bending of the cross members reaches a predetermined level.

Although the liner bag supporting arrangement and apparatus described in said application Ser. No. 416,580 has been found to be satisfactory for use with cargo materials of relatively low density, it has been found that with cargo materials of relatively high density, one or both of the front support cross members may bend beyond their elastic limit during handling of the container, e.g., during transporting or unloading thereof, due to the forces applied to such cross member. For example, with materials having a density between 20 and 100 lbs. per cubic foot, angles of repose between 10° and 50° and container unloading tilt angles up to 50°, the loading forces on the cross members may be as high as 13,500 lbs. Such forces are of such magnitude that if a tube or pipe of adequate strength is used for the cross members, such tube or pipe is either too large in diameter or too heavy to permit use thereof as part of a kit for installation in a container.

In addition, it will be observed that the front frame member described in said application Ser. No. 416,580, presses, at the upper end thereof, against a roof-bow of the roof of the container which means that the roof, which usually is made of aluminum, must withstand the forces applied thereto by the front frame member. An aluminum roof of normal construction cannot withstand forces of the magnitude described hereinbefore.

The present invention is an improvement over the liner bag supporting apparatus described in said application Ser. No. 416,580 and relates mainly to the front support for the liner bag. In the preferred embodiment of the invention, the front upper and lower ends of the liner bag are supported by a pair of transversely extending, flexible upper and lower cross members which are secured at their opposite ends to members of the container at the front thereof which, due to the container construction, can resist relatively high lateral forces. Such members may be, for example, the conventional corner castings or posts of the container, or may be specially installed, horizontal beams or channels secured at the front wall of the container and extending transversely thereof. Thus, the cross members can bend as required by the loading forces to distribute the forces on the liner bag attachment areas more nearly equally, and because the forces applied to the cross members are opposed by applying tension thereto, the cross members may be relatively small and light in weight even though the loading forces are high. Accordingly, such cross members may be described as flexible, load distributing members which, in use, are under tension.

The rear of the liner bag may be supported as described in said application Ser. No. 416,580 or may be supported, at least at its rear upper end, by an upper cross member similar to the front upper cross member and similarly secured at its ends to structural members at the rear of the container.

In the preferred embodiment of the invention, each of the cross members is a wire rope or cable with a collar or lug secured thereto at each of its opposite ends, and such rope or cable is suspended by such collars or lugs from brackets or hooks welded to the corner castings or posts of the container. Preferably also, the upper and lower transverse ends of the liner bag have tubular attachment portions extending for the width of the bag, and each cross member extends through one of such tubular portions. Tests which have been conducted show that such cross members and the container can successfully withstand the loading forces which may occur when the liner bag contains relatively dense materials and which may have the magnitude mentioned hereinbefore.

One object of the invention is to provide supporting apparatus in a cargo container for supporting a liner bag and which can withstand significantly greater loading forces than prior art supporting apparatus.

Another object of the invention is to provide liner bag supporting apparatus of such load capacity and which is simple in form and can readily be supplied to users in kit form.

These and other objects and advantages of the bulk cargo liner suspension and bulkhead system of the invention will appear more fully from the following detailed description of a preferred embodiment of the invention, when read in conjunction with the accompanying drawings, in which:

FIG. 9 is an enlarged, perspective view of a modified form of support bracket secured to a container corner casting;

Figures 1, 8:
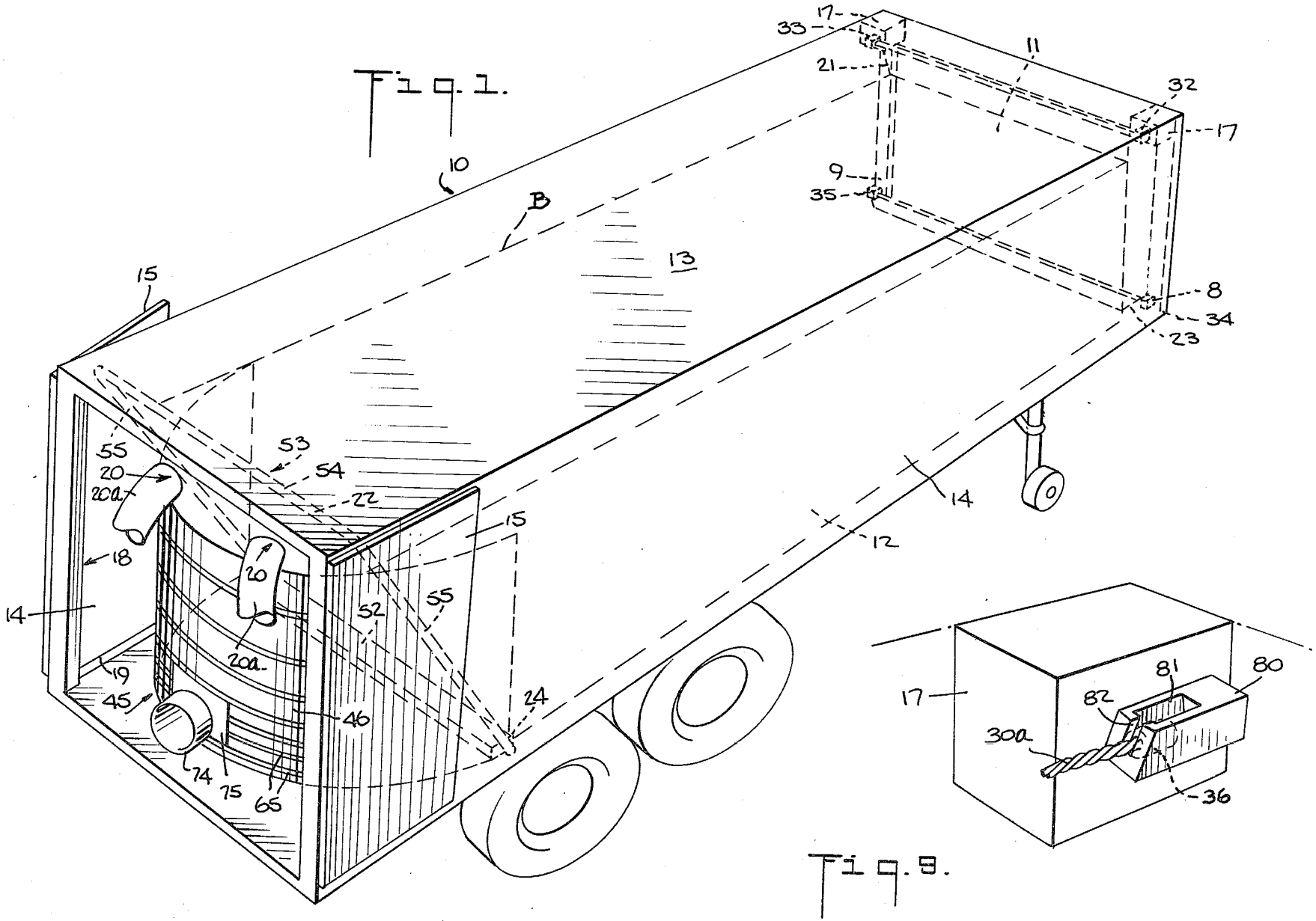
FIG. 1 is an overall view in perspective of a typical freight container equipped with a flexible liner bag and a suspension and bulkhead system according to the invention, internal structure being shown by dotted lines.
FIG. 8 is an enlarged, fragmentary, end view, partly in section, of an intalled upper support member of the invention with the front upper end of a liner bag thereon.
Figure 2:
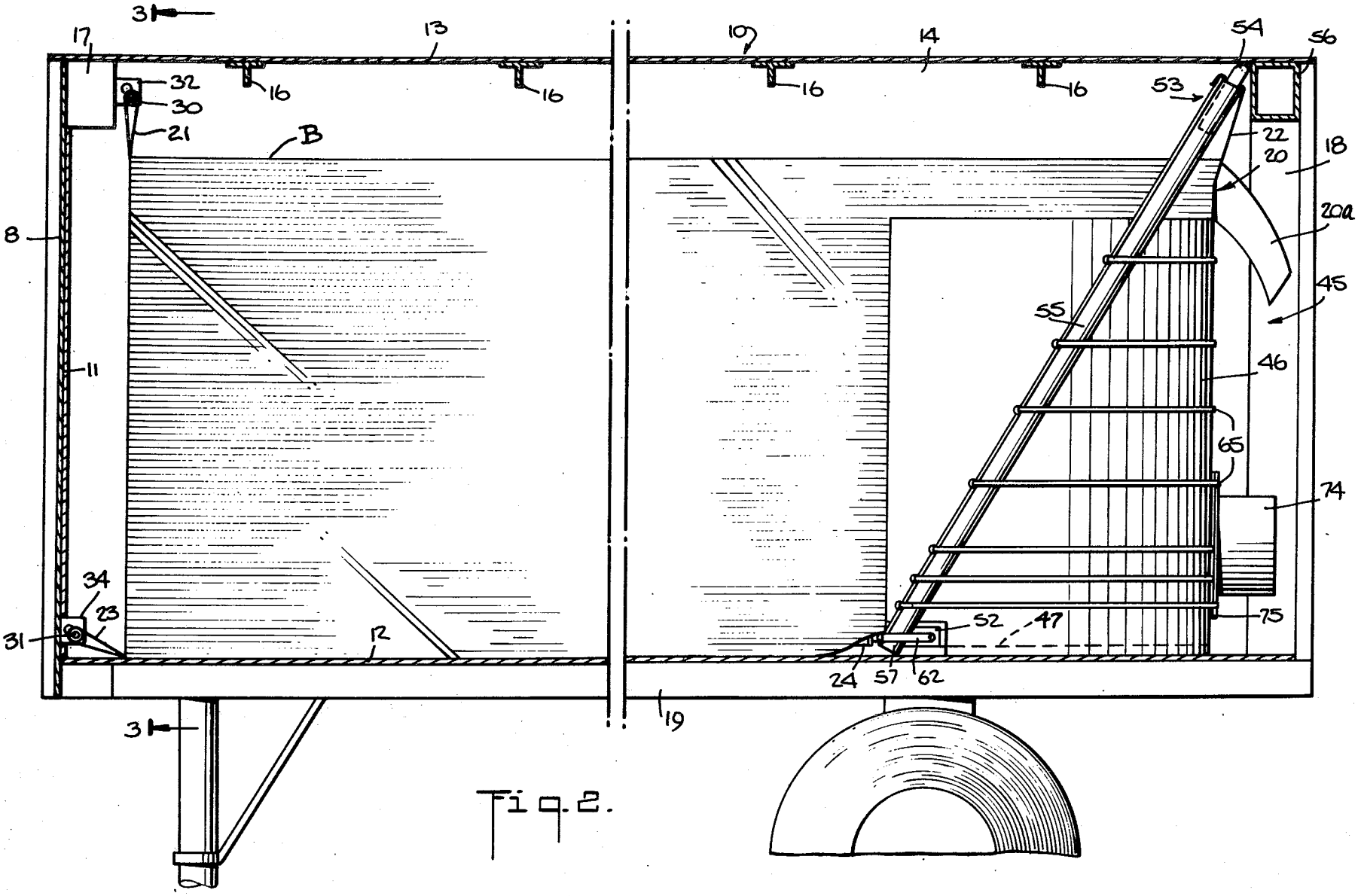
FIG. 2 is a fragmentary, side sectional view of the container of FIG. 1.
Figure 3:
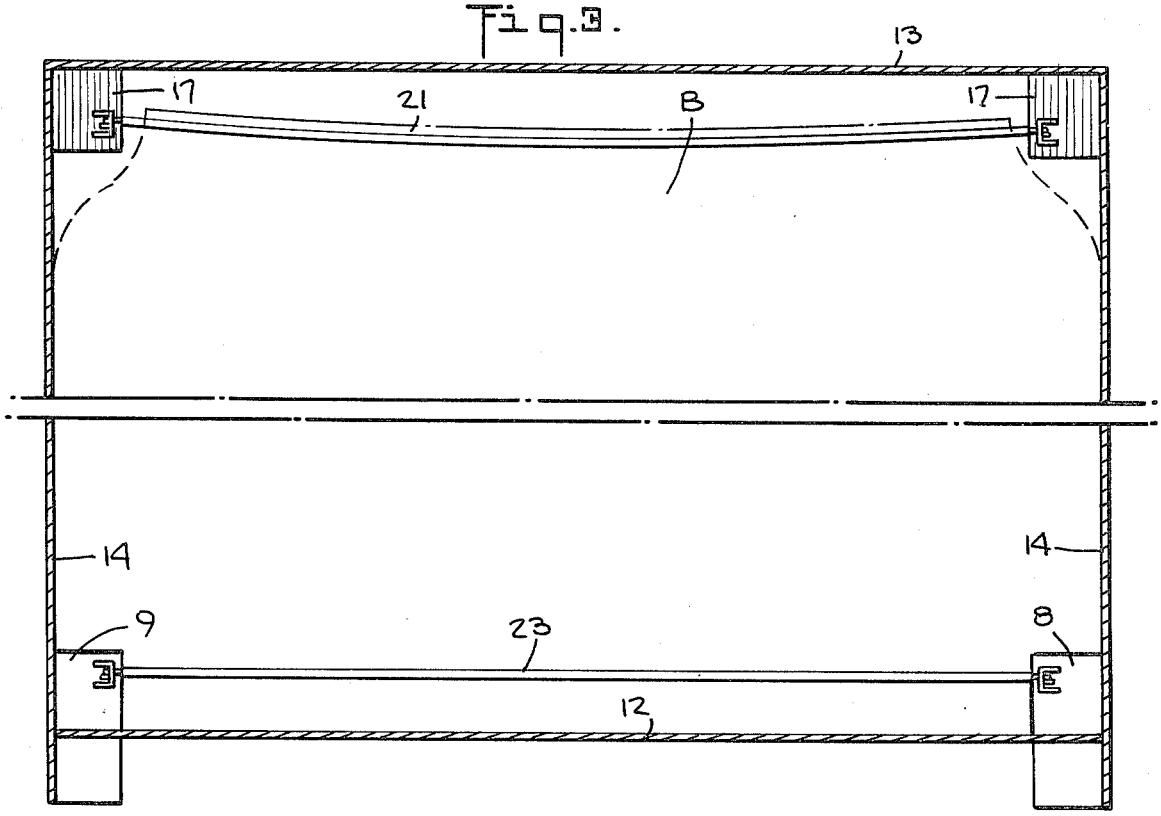
FIG. 3 is a fragmentary, sectional, end view of the containers of FIGS. 1 and 2 and is taken along the line 3—3 indicated in FIG. 2.

The conventional van-type freight container 10 shown in FIGS. 1 and 2 is of a type generally used for transport by ship and rail as well as by road when mounted on a wheeled chassis as shown. Containers such as the container 10 are provided in standard trailer truck sizes, about 8 or 8.5 feet high, 8 feet wide and either 20 or 40 feet in length. The generally box-like container 10 has a front wall 11, floor 12, roof 13, side walls 14 and rear doors 15. For simplicity, various structural elements of the container 10 are not shown in the drawing, but it will be noted that the roof 13 is supported by transverse members or roof-bows 16 (FIG. 2) shown as T-shaped in cross-section. In some commercially available containers, the roof-bows are of some other profile, such as channel-shaped, or it is possible that the roof itself might have transversely corrugated construction, but in any case, all conventional closed containers have transverse members or the like supporting or forming their roofs.

It will also be seen that the internal upper corners of the container 10 have structural corner castings 17 of block-like form for handling of the containers by means known in the art, and such castings 17 can resist relatively high forces tending to move them toward each other. The rear doors 15 are shown as hingedly mounted on a sturdy structural frame 18, including a transverse top member or header 56. Though other door arrangements can be provided, the arrangement shown isn typical. Longitudinal side rails 19 extend along each side of the container 10 at the floor 12.

Containers of the type described also usually have a pair of vertical, relatively rigid, structural front corner posts 8 and 9 which extend from the rails 19 to the roof 13. Usually, such posts 8 and 9 can resist relatively high forces tending to move them together because of the intervening container structure.

Figure 4:
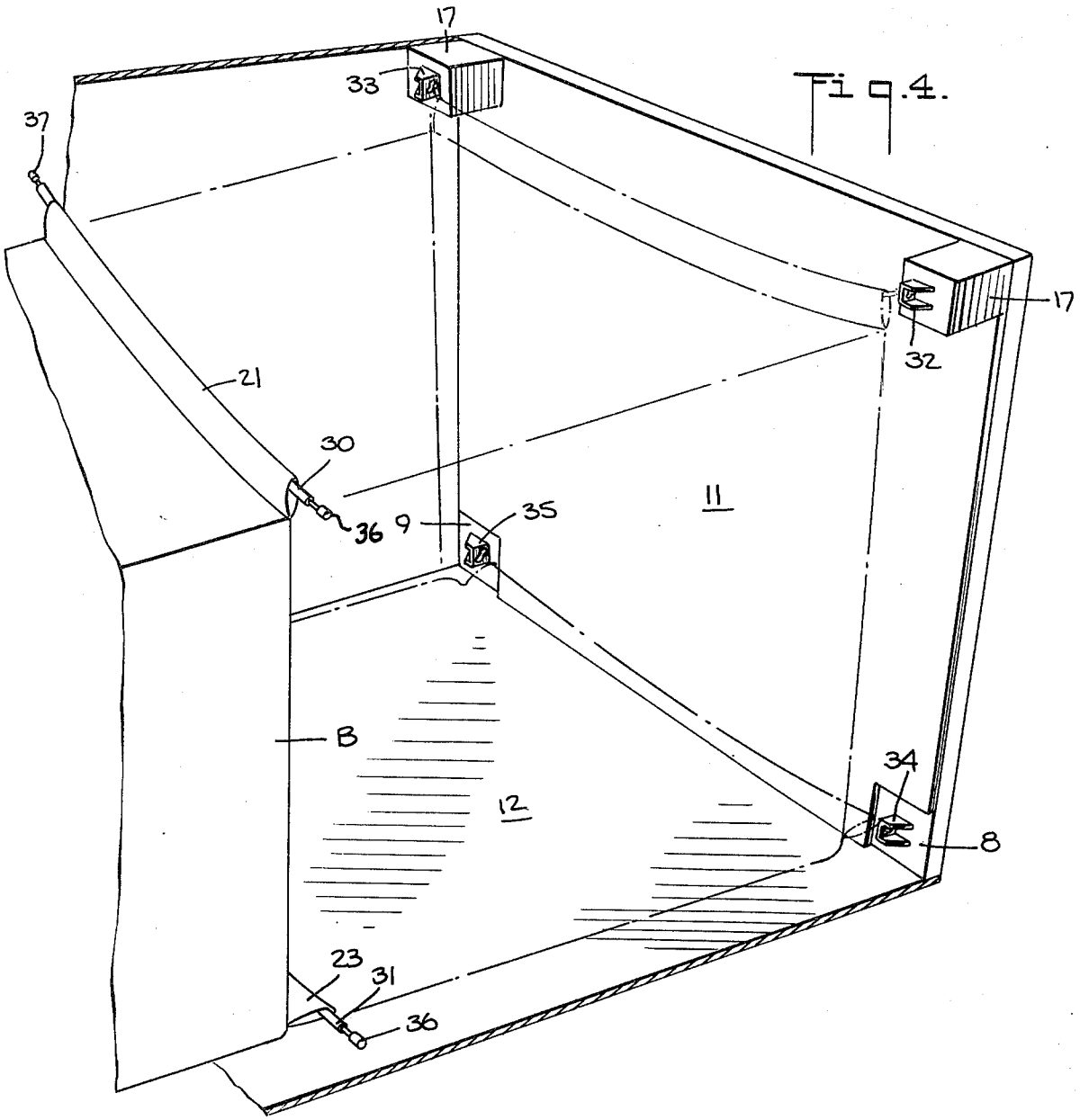
FIG. 4 is a fragmentary, perspective view, partly in section, of the front end of the container of FIG. 1 with the front end of the liner bag spaced from the front end of the container.
Figure 8:
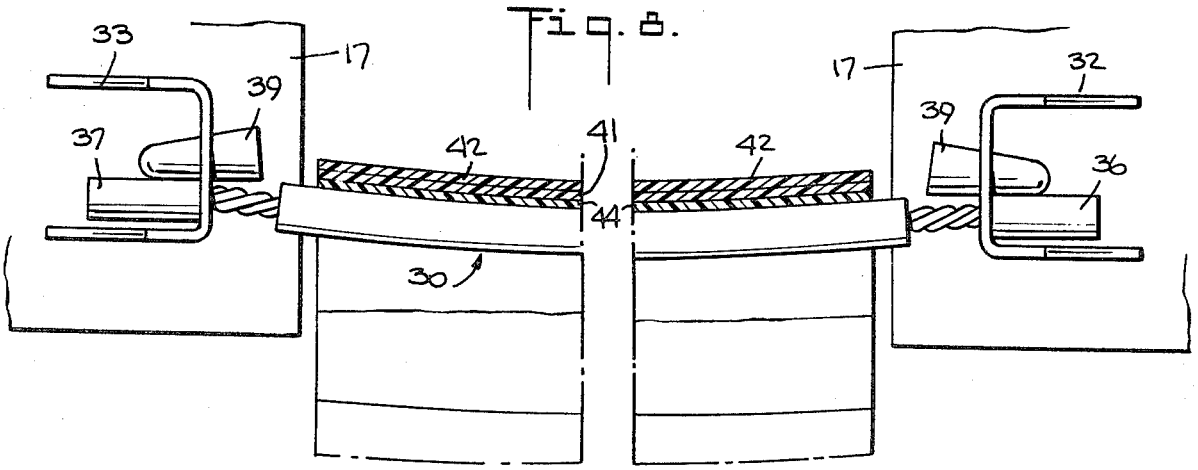

A flexible liner bag B adapted for suspension in the container 10 is shown in FIGS. 1, 2 and 4. The liner bag B can be formed as a seamless tube of polyethylene about 6 mils. thick, squared and sealed at its ends to provide a 20 or 40 foot long, generally rectangular bag. Since the typical container 10 is about 8 feet by 8 feet in cross-section, the diameter of a tube used to make the bag is about 10 feet. Further details of the bag B according to this invention will be discussed hereinafter, but it will be noted from FIGS. 1 and 2 that the bag B has two loading apetures 20 through its upper rear wall and is provided with transversely extending attachment areas 21 and 22 at its front and rear upper portions, respectively, and similar attachment areas 23 and 24 at its front and rear lower portions.

Liner bags fitted into containers in accordance with prior systems have tended to tear at or near their front ends, particularly at the top, under the forces of shifting cargo within the bags, especially when the container itself it tilted front end up through angles of 45° or more in unloading by pouring bulk cargo out of a discharge opening at the lower rear end of the bag. It is believed that such tearing at the top of the bag is due to insufficient support along the lower portions of its front end. According to the invention described in said application Ser. No. 416,580, such tearing is prevented by the employment of a front supporting frame which fits adjacent the front wall 11 of the container 10, extends between the floor 12 and roof 13 and bears against a cross bow 16.

As mentioned hereinbefore, a front supporting frame of the type described in said application Ser. No. 416,580 and the manner in which it is located and braced in a container 10 is satisfactory when the liner bag B contains relatively low density materials. However, it has been found that when such materials have a relatively high density, frame cross members of practical size and weight to be supplied as part of a kit cannot withstand the loading forces placed thereon by the liner bag B. Such forces may be at least 13,500 lbs. and can bend, or otherwise deform, light weight tubing or rod, thereby undesirably increasing the loading forces on other bag supporting members and, in some cases, causing collapse of the frame. In addition, the roof 13, usually being made of aluminum sheet, cannot withstand the loading forces applied by the upper part of the front supporting frame when the liner bag B contains such high density materials.

In the preferred embodiment of the invention, the front upper and lower transverse ends of the liner bag B are supported by a pair of flexible cross members 30 and 31 (FIG. 2), which are secured at their opposite ends to structural members of the container 10 so as to place the members 30 and 31 under tension when the liner bag B applies load thereto. However, if desired, and less satisfactory results are acceptable, only the cross member 30 or 31 may be used, and the opposite front end portion of the bag B may be supported by some other means, such as a front support member of the type described in said application Ser. No. 416,580. Thus, for example, the cross member 30 is received in brackets 32 and 33, the brackets 32 and 33 being welded to the corner castings 17. The cross member 31 has its ends received in brackets 34 and 35 welded, respectively, to the vertical corner posts 8 and 9. In some cases, such posts 8 and 9 are covered at their inner faces, such as by plywood, and in such cases, the inner covering is cut away to expose portions of the posts 8 and 9. As illustrated in FIGS. 5–8, each of the cross members 30 and 31 may be in the form of a flexible wire rope or cable **30*a* having cylindrical collars 36 and 37** swaged on the ends thereof.

Figure 5:
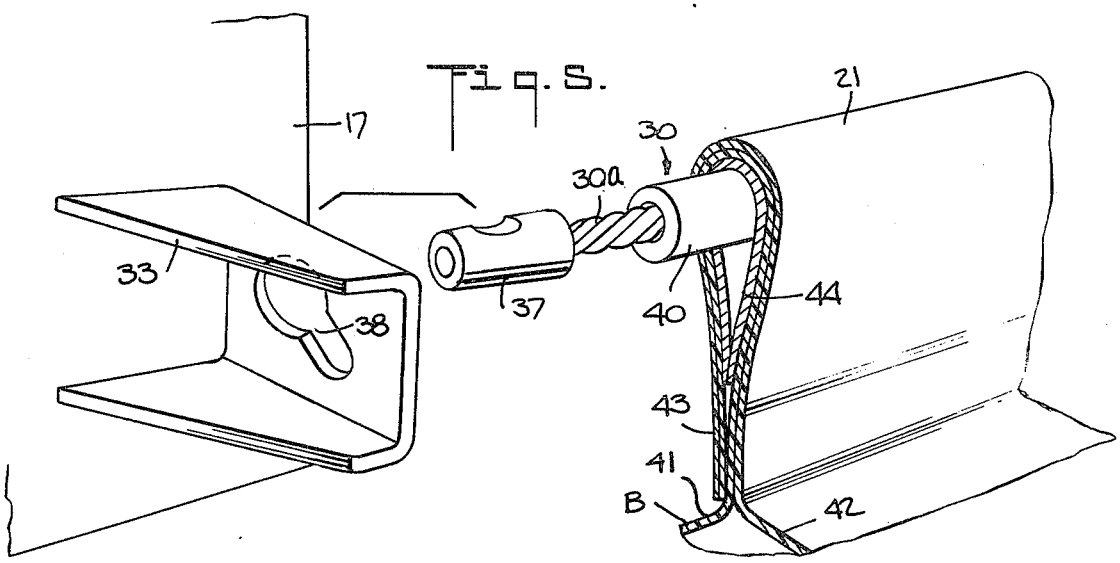
FIG. 5 is an enlarged, fragmentary, perspective view of an end of a support member of the invention and a supporting bracket therefor.
Figure 6:
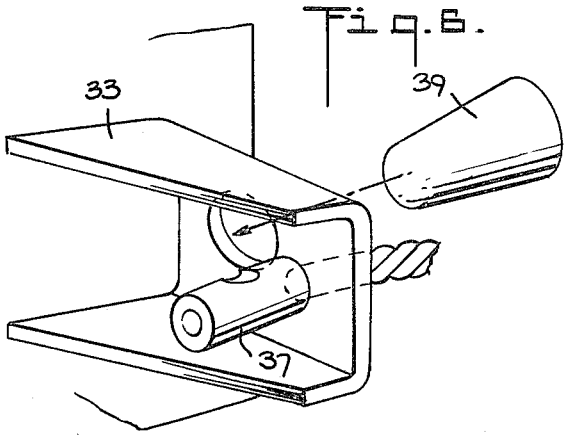
FIGS. 6 and 7 are enlarged, fragmentary, perspective views of an end of a support member of the invention illustrating the assembly thereof with a supporting bracket.
Figure 7:
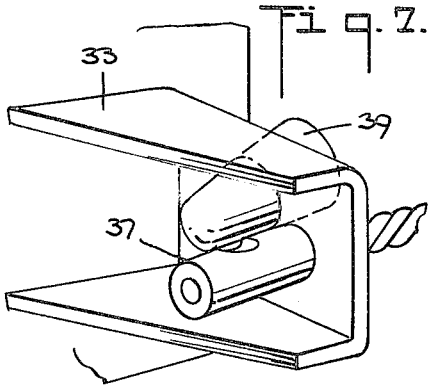

Each of the brackets 32–35 may be the same in construction and like the bracket 33 shown in FIGS. 5–7. Thus, the bracket 33 has a key-hole shaped slot 38, the larger end of which is large enough to receive the collar 37 and the smaller end of which is larger than the wire rope or cable **30*a*, but smaller than the outside diameter of the collar 37. The bracket 33 is shown as secured to a front upper casting 17 and, preferably, is secured thereto by welding of the bracket 33 to the casting 17**.

The distance between the inner ends of the collars 36 and 37 may be substantially equal to the distance between the brackets 32 and 33, so that the cross member 30 is substantially straight when it is installed. However, the distance between the two collars 36 and 37 may also be slightly greater than the spacing between the brackets 32 and 33, so that the wire rope or cable **30*a* hangs in catenary form. For example, the spacing between the inner faces of the collars 36 and 37 may be up to about 2 inches longer than the spacing between the brackets 32 and 33**.

After a collar, such as the collar 37, is inserted in the slot 38 of the bracket 33, it may be held in place in the slot 38 by driving a wedge 39 of truncated conical shape into the larger end of the slot 38, as indicated in FIGS. 6 and 7.

The wire rope or cable **30*a* may be relatively small in diameter and still withstand the loading forces which would be normally encountered with high density materials in the liner bag B. For example, the cable 30*a* may be ¼ inch galvanized aircraft cable which, tests have shown, is able to withstand loading forces in excess of 6,500 lbs. Accordingly, in spite of its small size and weight, the cross member 30 has strength sufficient to withstand the loading forces expected when the liner bag B contains high density materials. Also, the cross member 30 may be coiled for shipping purposes thereby reducing the shipping size of an installation kit. Preferably, the cable 30*a* is surrounded by a tube 40 (FIG. 5) of natural or synthetic rubber, or other soft material, so as to prevent abrasion of the attachment area 21 of the liner bag B by the cable 30*a***.

Although the bag attachment area construction and attaching device of the type described in said application Ser. No. 416,580 may be used to secure the liner bag B to the cross member 30, preferably, the liner bag B is looped around the cross member 30, as illustrated in FIG. 5, so as to provide a tubular attachment area 21 of at least double the thickness of the wall of the bag B. Thus, as shown in FIG. 5, two wall portions 41 and 42 of the bag B are brought together and folded back upon themselves so as to form the tubular attachment area 21. The ends of the wall potions 41 and 42 may be heat sealed together and to the wall portions 41 and 42 at the area 43 and, if desired, the tubular attachment area 21 may be further reinforce by including a strip 44 of a plastic material, such as a vinyl tape, which strip 44 may, if desired, be heat sealed to the surface of the wall portion 41.

The cross member 31 and the attachment area 23 at the front lower end of the bag B may be constructed respectively in the same manner as the cross member 30 and the front upper attachment area 21.

If desired, each of the brackets 32–35 may be replaced be a bracket of the form illustrated in FIG. 9. As shown in FIG. 9, the bracket 80 has an opening 81 large enough to receive the collar 36 at the end of the cross member 30 and a slot 82 larger than the diameter of the cable **30*a* but narrower than the outside diameter of the collar 36. Thus, when the collar 36 is inserted in the opening 82, the collar 36, and hence, the cable 30*a*, is retained by the end wall of the bracket 80 at the sides of the slot 82. The bracket 80 may be secured to the casting 17** such as by welding.

During shipment, cargo contained in a bag-lined container of the type here described can shift rearward or otherwise exert considerable pressure against the rear doors of the container. If the container is to be unloaded by tilting, the rear, lower end of the bag and the container doors will be heavily loaded. For these reasons, the internal, fairly light and flexible temporary bulkhead supporting frame and base assembly, as well as the supporting apparatus for the rear end of the liner bag, described in said application Ser. No. 416,580 are used in conjunction with the liner bag front end supporting apparatus of the present invention.

As described in said application Ser. No. 416,580, a sturdy, but light and flexible, aluminum sheet, easily formed into a curved shape, can be used very effectively as the bulkhead member 46 when reinforced by steel straps as will be described. However, other sheet materials, such as similarly reinforced paperboard or the like, could be used. As shown in FIGS. 1 and 2, the rear bulkhead member 46 when installed is bent or formed to a generally semicylindrical curvature. Since the standard container is about 8 feet wide, the length of the sheet forming the bulkhead member 46 should be somewhat over 12 feet. The height of the bulkhead member 46 can be considerably less than the height of the container, which makes it possible to load the bag B through the openings 20 after the bulkhead member 46 is in place. The bulkhead 46 forms a part of the rear frame and bulkhead assembly 45.

Referring now to FIG. 2, it will be seen that a generally semi-circular base member 47 fits transversely within the container resting on the floor 12. Its curved rear edge serves as a template against which the curvature of the bulkhead member 46 is formed. A transverse, bracing or spreader element 52 is attached atop and forms a part of the base member 47 and extends thereacross, adjacent to the front edge thereof.

To support the bulkhead member, a frame 53, having an upper cross member 54 and respective downwardly and forwardly extending side members or legs 55, is provided. The legs 55 are preferably straight lengths of pipe and the cross member 54 preferably has bent ends received in open upper ends of the legs 55, as shown in FIG. 2. Alternatively, the frame 53 can be unitarily formed of tubular pipe bent to a U-shape.

As shown in FIG. 2, the inverted U-shaped frame 53 is of such size that its upper cross member 54 rests against the transverse top header 56 of the rear door frame 18 of the container 10 when the lower ends 57 of the legs 55 are against the container floor 12. As illustrated in the drawings, the legs 55 are downwardly and forwardly inclinded to stand between the bulkhead member 46 and the sides 13 and 14 of the container. The bracing or spreader element 52 spreads the leg ends 57 apart, and has cut-out portions on the forward sides of its ends above cut-out corners of the base member to receive the leg ends 57. A strap 62 of flexible yet strong material, such as metal, attached at each end of the bracing element 52 can advantageously serve to position and hold the legs 55 at their ends 57.

A lower edge portion of the semi-cylindrical bulkhead 46 may be bent forward to form a flap portion fitted under the curved rear edge 48 of the base member 47, so that forces pressing downward hold the bulkhead member 46 tightly in place.

The rear side of the sheet bulkhead 46 is supported against pressures exerted in normal direction by the cargo within the bag B by a plurality of horizontally, or semicircumferentially disposed steel straps 65 secured at their ends to the legs 55 of the frame 53. Since the normal pressure distribution of the cargo load on the bulkhead member 46 provides greater force against the lower area as compared with the upper area of the bulkhead, it is desirable for the reinforcing straps 65 to be closer together within the lower area, as shown in FIGS. 1 and 2, to provide the required additional support. The load distribution can be readily determined by methods known in the art, and the horizontal straps 65 can be vertically spaced accordingly.

The lengths of the successive straps 65 necessarily become shorter from the lowest to the highest strap, because of the slanted orientation of the legs 55. The lengths of the straps 65 will, of course, depend upon their spacing during use, but the assembly can be readily standardized for a standard container arrangement. The upper rear attachment area 22 of the bag may be secured along the length of the cross member 54 and the lower rear attachment area 24 can be secured to means on the spreader element 52 in the manner described in said application Ser. No. 416,580. However, if desired, brackets similar to brackets 32 and 33 may be welded to the header 56 of the door frame 18 and the upper rear attachment area 22 of the bag may be suspended therefrom by a cross member 30.

The described internal rear bulkhead and frame assembly 45 of the invention is adequate to support the entire cargo load during tilt-unloading thereof through the rear doorway, and not only eliminates the necessity for external bulkheads used in certain prior sytems during unloading, but also distributes stresses to the header 56 of the frame 18 during transport rather than to the container doors 15. A further advantage resides in the curved configuration of the bulkhead, being curved on a radius extending from a location within the container 10, which acts as a funnel as the cargo is being poured from the lower rear end of the container 10 and bag B. The central lower area of the bulkhead member 46 has a port fitted with a stovepipe type transition spout 74 which can receive a tubular conveyor hose (not shown).

To unload cargo, the bag B is pierced and cut away over the cofacing area of the opening in the spout 74 of the bulkhead member 46, the container 10 is tilted by lifting its forward end, and a pipe, hose or other known unloading means, if its is attached, can receive the cargo from the bag via the spout 74 through which the cargo pours. As shown in FIGS. 1 and 2, the straps 65 can overlie and retain a plate-like flange 75 of the spout 74 to hold the spout in place.

It should be noted that the bulkhead member 46 is spaced away from the rear doors 15 of the container 10 in the forward direction, as shown in FIG. 2, so that cargo load forces are not exerted against the doors themselves. This spacing also permits installation of the spout 74 prior to loading as is desirable, since the doors 15 can be closed even with such a spout 74 in position.

It has been noted that in areas above the bulkhead member 46 the bag B has loading apertures 20 for loading purposes. These apertures 20 are shown to be fitted with sleeves **20*a***, one for connection to a pneumatic feed line for bulk cargo, and the other to permit the exhausting of air from the bag while bulk cargo is being loaded to relieve pressure therein.

The bag B has some freedom of movement, and, as described in said application Ser. No. 416,580, is resiliently mounted with respect to the frame means 53 described, to better absorb the shock of shifting of loads during transport, loading and discharge. Whatever the attachments means employed, the installation of a bag B according to the invention can easily be done by two men in a short time. It is contemplated that the bag will be furled or rolled, forming a convenient package with the frames, bulkhead and base member. The brackets 32–35 will have been previously installed, and the installers will insert the cross members 30 and 31 into the attachment areas 21 and 23 so that the front end of the liner bag B will appear as shown in solid lines in FIG. 4. The installers will then carry the bag B forward and insert the ends of the cross members 30 and 31 in the brackets 32–35 and secure them in place with the wedges 39.

The installers then walk in rearward direction of the container, unrolling or unfurling the bag towards its rear end. The base member 47 is then positioned on the floor of the van and the bag attachment area 24 is secured to the cross brace 52, if desired. The rear frame legs 55 and cross member 54 are generally positioned between the base member and the top of the container, if not its rear header 56, and the attachment area 22 of the bag B is secured to the upper cross member 54. Then the bulkhead member 46 is positioned behind the bag and the reinforcing metal straps 65 are lifted into their vertically spaced relationship. At such time the installers are outside of the container 10, behind the doorway frame 18.

It has been found that attachment of the bag B to the rear cross member 54 can be facilitated by inflating the bag, for example, by use of a fan to blow in air through one of the bag openings 20 thereof. Inflation of the bag brings the upper attachment area 22 closer to the cross member 54 to which the bag can then be easily secured.

The bag B is filled with bulk cargo by known means through one of the bag apertures 20 and readied for shipment by tying off the sleeves 20*a* and closing and sealing the container doors 15.

Figure 10:
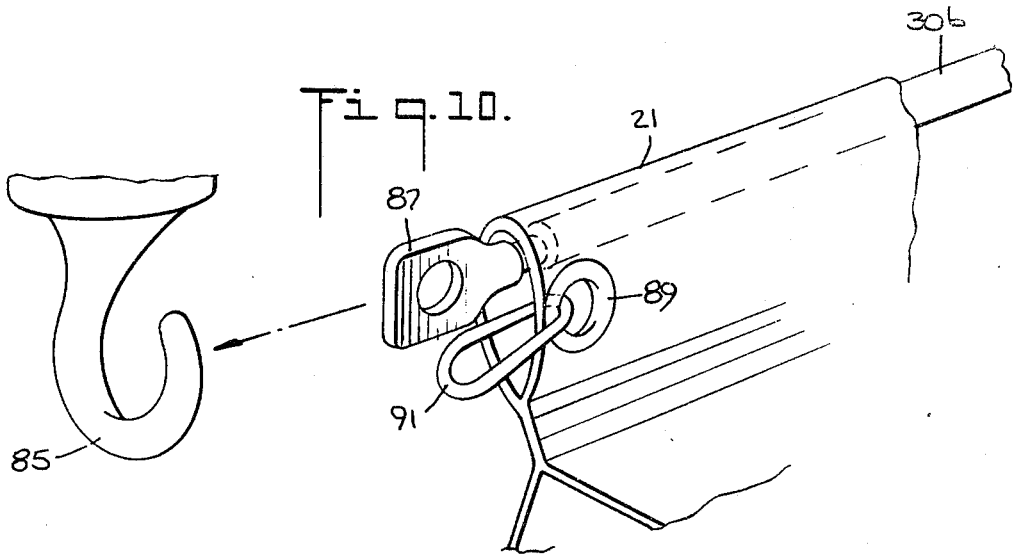
FIG. 10 is an enlarged, fragmentary, perspective view of a modified form of support member end and a supporting bracket therefor.
Figure 12:
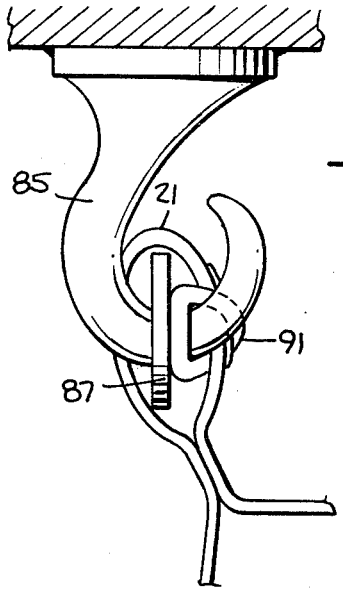
FIG. 12 is a side elevation view of the embodiment illustrated in FIG. 11.
Figure 11:
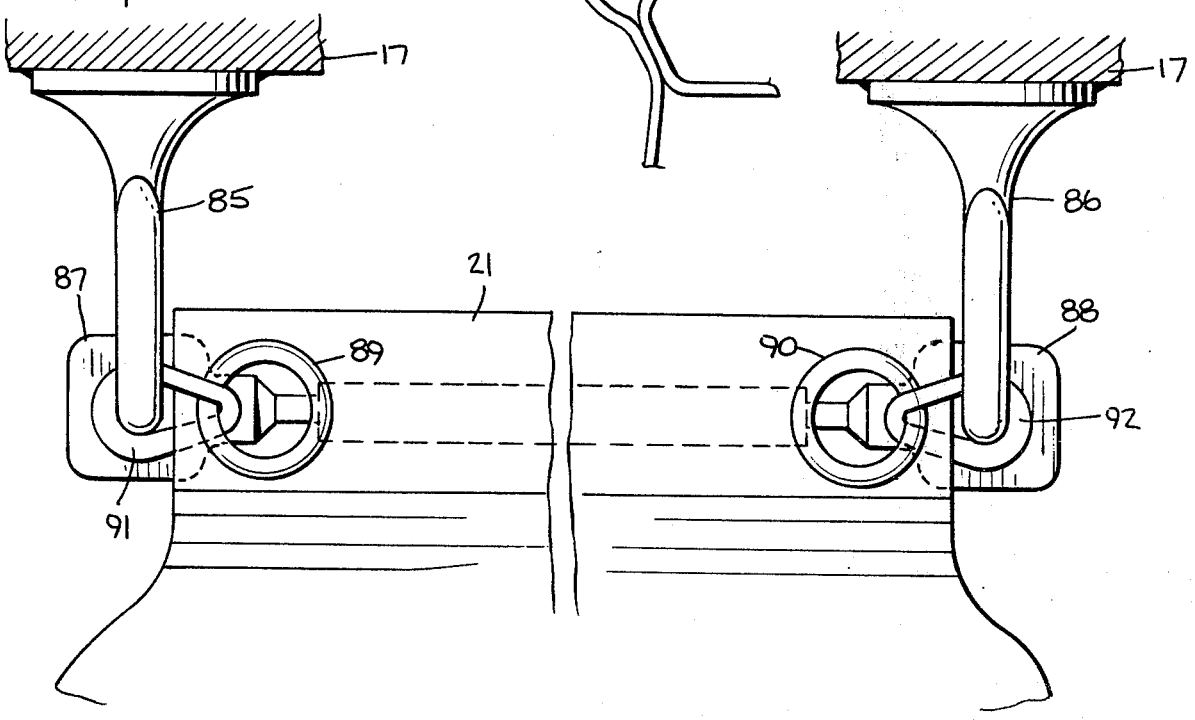
FIG. 11 is an enlarged, fragmentary, end view of the embodiment of the support member illustrated in FIG. 10 installed on a container and with a liner bag supported thereby.

Although it is preferred to support the cross members 30 and 31 in the manner described hereinbefore, it is of course possible to provide support therefor in other ways known to those skilled in the art. For example, as illustrated in FIGS. 10–12, the cross members 30 and 31 may be supported by hooks, such as the hooks 85 and 86 welded to the corner castings 17 or to the vertical corner posts 8 and 9. With such hooks, the cross members, such as the cross member 30*a* illustrated in FIGS. 10 and 11, may have apertured lugs 87 and 88 substituted for the collars 36 and 37. Otherwise the construction of the cross member 30*b* is the same as the construction of the cross member 30. The lugs 87 and 88 fit over the hooks 85 and 86 to hold the cross member 30*b* in the desired position. The attachment area 21 of the linear bag B may have the same construction as described hereinbefore in connection with FIG. 5, but, for the purpose of preventing longitudinal shifting of the attachment area 21 along the cross member 30*b*, grommets 89 and 90 may be installed at the ends of the attachment area 21. The ends of the attachment area 21 may be secured to the hooks 85 and 86 by loops 91 and 92 which may, for example, be made of elastic material, such as shock cord.

The brackets 32 and 33 have been shown as secured to the rearwardly facing surfaces of the corner castings 17 and, while the hooks 85 and 86 may be similarly mounted on such surfaces, they may also be mounted on the surfaces of the corner castings 17 which face toward the floor 12, as illustrated in FIGS. 11 and 12.

Numerous other modifications, substitutions and applications of the invention will suggest themselves to those acquainted wtih the art. For example, despite the fact that the various elements of the system of the invention cooperate very advantageously, one or more might be omitted or replaced by prior art structures with a corresponding loss of some advantages of the present invention. Tte system of the invention may also be adapted for use with non-standard size containers, trailers, or other car bodies. These and other modifications are considered to be within the spirit and scope of the invention.

Thus has been described a means for installing and supporting a bulk cargo liner bag in a container, which achieves all of the objects of the invention.

What is claimed is:

1. In a cargo container of the type having a floor, side walls, a roof, a rear doorway and a front wall, said front wall having a pair of laterally spaced portions resistent to displacement toward each other and disposed adjacent one of said floor and said roof, a liner bag adapting the container for receiving bulk cargo, and supporting means for supporting said liner bag within the container, comprising front supporting means including a flexible, load distributing cross member extending transversely and continuously substantially across said front wall of the container, said cross member being flexible in the sense that it is deformable under load applied in lateral direction along the length thereof to distribute said load substantially uniformly therealong, means securing said cross member at one of its ends to one of said portions and at its opposite end to the other of said portions, said liner bag having respective transversely extending upper and lower front end attachments areas, one of said liner front end attachment areas being connected to and extending along said cross member, and retaining means retaining the other of said liner front end attachment areas substantially adjacent to and extending transversely substantially across said front wall of the container at a height location spaced from said cross member whereby, when said container is tilted to unload said bulk cargo via its said rear doorway, said cross member retains the liner front end attachment area connected thereto in position substantially adjacent to said front wall and said cross member is held under tension.

2. In a cargo container, a liner bag and supporting means as set forth in claim 1, wherein said portions are adjacent said container floor, said liner bag attachment area extends along the lower portion of said liner bag front end, and said cross member comprises a flexible wire cable.

3. In a cargo container, a liner bag and supporting means as set forth in claim 1, wherein said flexible cross member has a soft material covering therealong.

4. In a cargo container, a liner bag and supporting means as set forth in claim 1, wherein said liner bag attachment area has tubular configuration extending substantially along the width of said liner bag.

5. In a cargo container, a liner bag and supporting means as set forth in claim 4, which further includes means attaching said tubular attachment area at each of its ends to the respective of said laterally spaced portions on said container front wall.

6. In a cargo container, a liner bag and supporting means according to claim 5, wherein said tubular attachment area has grommet means at each end thereof, and said tubular attachment area is attached to said laterally spaced portions of said front wall by means connecting the respective of said grommet means to the adjacent one of said portions.

7. In a cargo container, a liner bag and supporting means as set forth in claim 4, wherein said tubular attachment area has wall thickness which is at least double the wall thickness of said liner bag.

8. In a cargo container, a liner bag and supporting means accoridng to claim 4 wherein said tubular attachment area has reinforcing means disposed therealong.

9. In a cargo container, a liner bag and supporting means as set forth in claim 1, wherein said portions are adjacent said container roof, said liner bag attachment area extends along the upper portion of said liner bag front end, and said cross member comprises a flexible wire cable.

10. In a cargo container, a liner bag and supporting means as set forth in claim 9, wherein said container has a further pair of laterally spaced portions resistant to displacement toward each other and disposed adjacent said floor, and wherein said retaining means comprises a further flexible, load distributing cross member extending transversely substantially across said front wall and means securing said further cross member at one of its ends to one of said further portions and at its opposite end to the other of said further portions, said other of said liner front end attachment areas being connected to and extending along said further cross member.

11. In a cargo container, a liner bag and supporting means as set forth in claim 10, wherein said further cross member comprises a flexible wire cable.

12. In a cargo container, a liner bag and supporting means as set forth in claim 11, wherein said first-mentioned pair of portions are corner castings of said container.

13. In a cargo container, a liner bag and supporting means as set forth in claim 12, wherein said further pair of portions are vertical support posts of said container.

14. In a cargo container, a liner bag and supporting means as set forth in claim 13, wherein said securing means comprises brackets welded to said castings and brackets welded to said support posts and wherein each of said cross members comprises means at its ends engageable with said brackets.

15. In a cargo container, a liner bag and supporting means as set forth in claim 1, further comprising a substantially vertical bulkhead means extending across said container adjacent to but spaced forwardly away from said rear doorway and supporting a rear end area of said liner bag, and retaining means retaining said bulkhead means in its said position.

16. In a cargo container, a liner bag and supporting means as set forth in claim 15, wherein said liner has transversely extending upper rear end attachment areas, and further comprising means for retaining said liner upper rear end attachment area substantially adjacent to and extending transversely across said roof of the container, said last-mentioned means comprising a rear end upper cross member extending transversely and continuously substantially across said container adjacent to its said roof, and means retaining said upper cross member in such position, said liner upper rear end attachment area being connected to and along said rear end upper cross member.

17. In a cargo container, a liner bag and supporting means as set forth in claim 16, wherein said bulkhead retaining means includes a pair of substantially upright parallel side members adjacent to the respective side walls of said container and extending substantially between said container floor and roof means retaining said parallel side members in such positions, and means retaining said vertical bulkhead means in position extending between and supported by said side members against rearward movement.

18. In a cargo container, a liner bag and supporting means as set forth in claim 15, wherein said first-mentioned portions are adjacent said roof, said liner bag attachment area extends along the upper portion of said liner bag front end, and said cross member comprises a flexible wire cable.

19. In a cargo container, a liner bag and supporting means as set forth in claim 18, wherein said container front wall has a further pair of laterally spaced portions resistant to displacement toward each other and disposed adjacent said container floor, and wherein said retaining means comprises a further flexible, load distributing cross member extending transversely and continuously substantially across said front wall, and means securing said further cross member at one of its ends to one of said further portions and at its opposite end to the other of said further portions, said other of said liner front end attachment areas extending along the lower portion of said liner bag front end and being connected to and extending along said further cross member.

20. In a cargo container, a liner bag and supporting means as set forth in claim 19, wherein said further cross member comprises a flexible wire cable.

* * * * *

UNITED STATES PATENT OFFICE

CERTIFICATE OF CORRECTION

PATENT NO. : 3,980,196

DATED : September 14,1976

INVENTOR(S) : John T. Paulyson and John P. Travis

It is certified that error appears in the above-identified patent and that said Letters Patent are hereby corrected as shown below:

Column 13, line 13, before "has", insert --front wall--.

Column 14, line 19, after "roof" and before "means", insert --and--.

Signed and Sealed this

Ninth Day of November 1976

[SEAL]

*Attest:*

RUTH C. MASON
*Attesting Officer*

C. MARSHALL DANN
*Commissioner of Patents and Trademarks*